United States Patent [19]

Takagi et al.

[11] 4,404,798

[45] Sep. 20, 1983

[54] EXHAUST GAS CLEANING DEVICE FOR INTERNAL COMBUSTION ENGINE

[75] Inventors: Shigeru Takagi, Anjo; Yukihisa Takeuchi, Aichi; Shigeru Kamiya, Chiryu; Masahiro Tomita, Anjo; Kiyohiko Oishi, Susono; Kiyoshi Kobashi, Mishima, all of Japan

[73] Assignees: Nippon Soken, Inc., Nishio; Toyota Jidosha Kogyo Kabushiki Kaisha, Toyota, both of Japan

[21] Appl. No.: 309,408

[22] Filed: Oct. 7, 1981

[30] Foreign Application Priority Data

Oct. 9, 1980 [JP] Japan ..... 55-141793

[51] Int. Cl.[3] ..... F01N 3/02

[52] U.S. Cl. ..... 60/296; 55/282; 55/287; 55/466; 55/DIG. 10; 55/DIG. 30; 60/311

[58] Field of Search ..... 60/296, 297, 311, 303, 60/288; 55/DIG. 30, DIG. 10, 282, 466, 287

[56] References Cited

U.S. PATENT DOCUMENTS

| | | | |
|---|---|---|---|
| 2,898,202 | 8/1959 | Houdry | 60/296 |
| 4,167,852 | 9/1979 | Ludecke | 60/296 |
| 4,281,512 | 8/1981 | Mills | 55/DIG. 30 |
| 4,345,431 | 8/1982 | Suzuki | 55/DIG. 30 |

*Primary Examiner*—Douglas Hart

*Attorney, Agent, or Firm*—Cushman, Darby & Cushman

[57] ABSTRACT

An exhaust gas cleaning device for an internal combustion engine comprises a housing provided with an inlet port which is communicated with an exhaust pipe of an internal combustion engine and an outlet port, two particulates collecting members disposed in two independent exhaust gas flowing passages which are communicated with the inlet port through an inlet chamber and with the outlet port through an outlet chamber, a butterfly valve provided in the inlet chamber for alternately directing the exhaust gases into either one of the exhaust gas flowing passages and a heated air supplying means for burning off the particulates collected by the particulates collecting members, which is provided with a heated air outlet port opening into the inlet chamber so as to be opposed to the inlet port with the butterfly valve therebetween.

13 Claims, 8 Drawing Figures

EXHAUST GAS CLEANING DEVICE FOR INTERNAL COMBUSTION ENGINE

BACKGROUND OF THE INVENTION

The present invention relates to an exhaust gas cleaning device for eliminating particulates such as carbon particles in exhaust gases of an internal combustion engine, particularly to an exhaust gas cleaning device provided with particulates collecting members and a heated air supplying means for burning the particulates collected by the particulates collecting members.

The present invention more particularly relates to an exhaust gas cleaning device provided with two particulates collecting members which alternately collect particulates, and a heated air supplying means by which the particulates previously collected by an inactive particulates collecting member are burnt off.

FIG. 1 shows one example of the conventional exhaust gas cleaning device of such a type as described above, which is disclosed in Japanese published unexamined patent application No. Sho 55-19934.

On the downstream side of an internal combustion engine 1, the exhaust gas cleaning device is disposed so that exhaust gases discharged from the internal combustion engine 1 flow therethrough.

The exhaust gas cleaning device is composed of a housing 4, an inlet port 2 through which the exhaust gases flow into the exhaust gas cleaning device, and an outlet port 3 through which the exhaust gases flow out of the exhaust gas cleaning device.

Within the housing 4, two independent exhaust gas flowing passages 51 and 52 are formed, and in both end portions of the exhaust gas flowing passages 51 and 52, an exhaust gas inlet chamber 6 communicated with the inlet port 2 and an exhaust gas outlet chamber 7 communicated with the outlet port 3 are formed.

In each of the flowing passages 51 and 52, heat resistant filter members 81 and 82 for collecting particulates are provided respectively.

And in the exhaust gas inlet chamber 6, an exhaust gas diverter valve 9 for directing the flow of exhaust gases to either one of the collecting members 81 and 82 is provided. Therefore, the exhaust gases containing particulates such as carbon particles discharged from the internal combustion engine 1 flow into the collecting member 81 as shown by hatched arrows, in FIG. 1, for example.

And the exhaust gases are cleaned while passing the collecting member 81 and are discharged out of the outlet port 3 as shown by white arrows.

The conventional cleaning device shown in FIG. 1, is further provided with a burner 101 and a blower 102 for heating and burning the particulates previously collected by the inactive collecting member 82.

The heated air produced by the burner 101 and the blower 102 is supplied into a heated air supplying passages 511 or 512 through a heated air outlet port 105 by the operation of a heated air diverter valve 91. And the heated air supplied into the heated air supplying passage 511 or 512 flows into the exhaust gases flowing passage 51 or 52. When the exhaust gases flow through the particulates collecting member 81, the heated air is supplied into the heated air supplying passage 512 and flows into the exhaust gas flowing passage 52 as shown by broken arrows. Then, the heated air passes the collecting member 82 while burning the particulates previously collected thereby and mixes with the cleaned exhaust gases in the outlet chamber 7.

The mixture is discharged out of the housing 4 through the outlet port 3.

When the volume of the particulates collected by the active collecting member 81 or 82 reaches such a level as to block the flow of the exhaust gases, a differential pressure detector 18, or 19 which measured the pressure difference between the downstream side and the upper stream side of the collecting member 81 or 82, detects the above described timing. And at such a timing, the exhaust gas diverter valve 9 and the heated air diverter valve 91 are changed into the position shown by imaginary lines by means of a manual or automatic control device (not shown). consequently, the passage through which the exhaust gases flow and that into which the heated air is supplied are changed. And the particulates collecting operation is alternated from one particulates collecting member into another particulates collecting member.

Then, the particulates previously collected by the inactive particulates collecting member are burnt off so that particulates are prevented from clogging the particulates collecting member.

The conventional particulates cleaning device as shown in FIG. 1 has such excellent effects as described above. However, it still has various problems to be improved. Namely, it is required to make the device simpler, smaller, and lighter and also to provide a device durable against high temperature.

In the conventional particulates cleaning device shown in FIG. 1, the exhaust gas diverter valve 9, the heated air supplying means 101 and 102, the heated air diverter valve 91, the heated air supplying passages 511 and 512 and a control means (not shown) for operating the exhaust gas diverter valve 9 and the heated air diverter valve 91 coincidently, are required.

Consequently, the whole device becomes so large, heavy and complex that it is difficult to mount such a device in a limited space within a vehicle.

In order to burn the particulates collected by the inactive collecting member, the inactive collecting member must be maintained at a high temperature not less than 600° C.

Therefore, the temperature of the heated air supplied from the heated air supplying means 101 and 102 must be maintained at a temperature as high as 800° C. to 900° C.

Consequently, the heated air diverter valve 91 is exposed to high temperature air flow. And since within the heated air supplying passages 511 and 512, exhaust gases heated by the heated air supplied from the heated air supplying means 101 and 102, stay, the heated air diverter valve 91 is further heated thereby.

As a result, on the valve shaft of the heated air diverter means 91, galling is apt to occur and durability of the valve plate and the valve shaft thereof is decreased.

Accordingly, one object of the present invention is to provide a small sized exhaust gas cleaning device having a simple construction, which is mainly composed of particulates collecting members for alternately catching and collecting the particulates contained within exhaust gases, and a heated air supplying means for heating and burning the particulates previously collected by the inactive collecting member.

Another object of the present invention is to provide an exhaust gas cleaning device of which members, particularly such a member as to be exposed to heated air supplied by the heated air supplying means, can be prevented from overheating.

DESCRIPTION OF THE DRAWINGS

Other objects and advantages of the invention will become apparent from the following description of embodiments with reference to the accompanying drawings wherein:

FIG. 2 is a longitudinal sectional view of a first embodiment;

FIG. 3 is a cross sectional view taken along the line III—III of FIG. 2;

FIG. 4 is a horizontal sectional view taken along the line IV—IV of FIG. 2;

SUMMARY OF THE INVENTION

The exhaust gas cleaning device of the present invention comprises two independent exhaust gas flowing passages provided with a particulates collecting member respectively, an inlet port and an outlet port which are communicated with the exhaust gas flowing passages through an inlet chamber and an outlet chamber respectively.

In the inlet chamber, a butterfly valve is provided as an exhaust gas diverter valve for alternately directing exhaust gases into the exhaust gas flowing passages, and a heated air outlet port opens into the inlet chamber so as to be opposed to the inlet port with the butterfly valve between.

According to the present invention, by means of single butterfly valve, the exhaust gases can be alternately directed into the exhaust gas flowing passages, and the heated air can be supplied into the exhaust gas flowing passage wherein the exhaust gases do not flow.

And since the butterfly valve which is exposed to the heated air supplied through the heated air outlet port, is cooled by the exhaust gases of which temperature is lower than that of the heated air, and which flow along the reverse surface thereof, the butterfly valve can be prevented from overheating.

Furthermore, since the direction of the exhaust gas flow and the heated air flow can be coincidently changed by only operating a single butterfly valve, the heated air diverter valve, the heated air supplying passage and the control device for operating the exhaust gas diverter valve and the heated air diverter valve coincidently which are required by the conventional exhaust gas cleaning device, are unnecessary.

DETAILED DESCRIPTION OF THE INVENTION

Hereinafter, the present invention will be explained in detail in accordance with embodiments with reference to the accompanying drawings.

Figure 2:
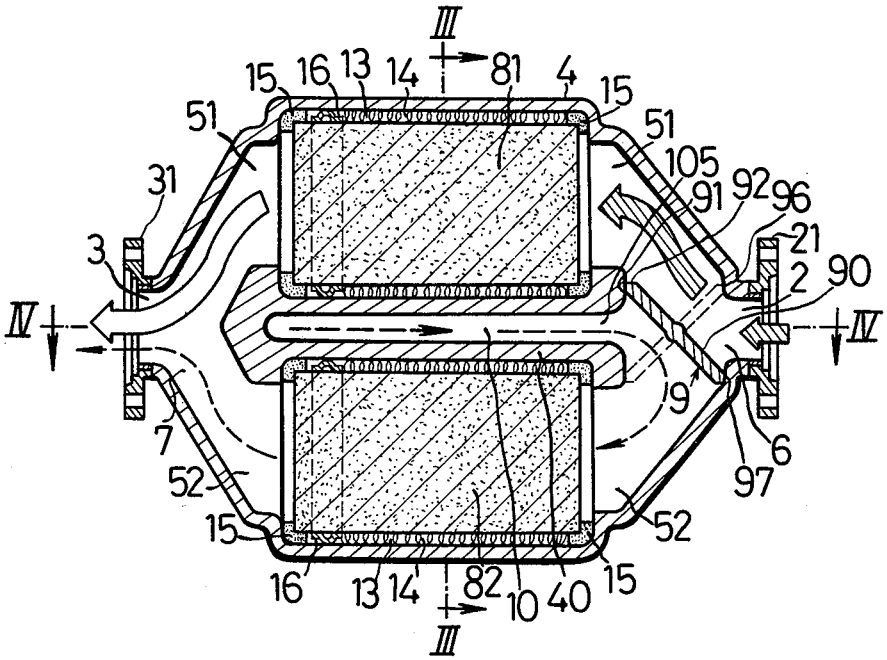
FIG. 2, FIG. 3 and FIG. 4 show a first embodiment of the present invention.
Figure 3:
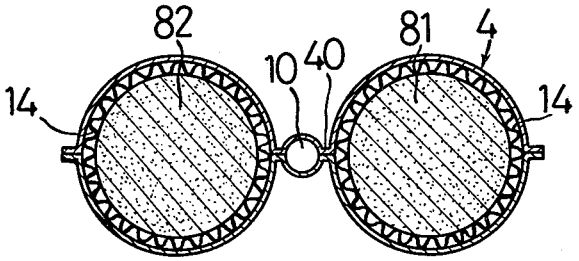
Figure 4:
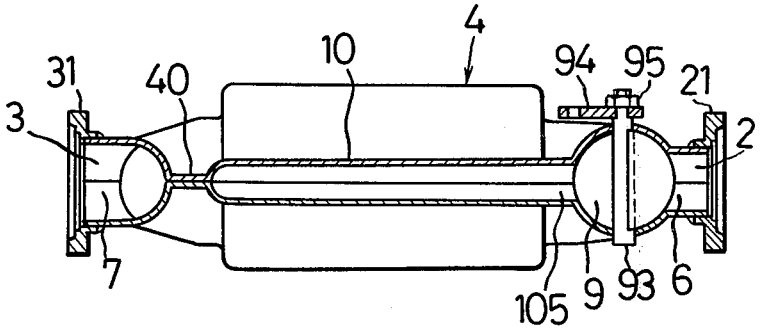

FIGS. 2, 3 and 4 show the exhaust gas cleaning device of a first embodiment of the present invention.

The exhaust gas cleaning device of the first embodiment is composed of a housing 4 provided with an inlet port 2 through which the exhaust gases discharged from an internal combustion engine into the housing 4 and an outlet port 3 through which the cleaned exhaust gases flow out of the housing 4.

Within the housing 4, a first and a second exhaust gas flowing passages 51 and 52 which are separated from each other by a partition wall 40 and which are communicated with the inlet port 2 and the outlet port 3 respectively, are formed.

On the upper stream side of the flowing passages 51 and 52, an exhaust gas inlet chamber 6 is formed and on the downstream side of the flowing passages 51 and 52, an exhaust gas outlet chamber 7 is formed.

And in the exhaust gas flowing passages 51 and 52, particulates collecting members 81 and 82 are disposed respectively. And in the inlet chamber 6, a diverter valve 9 is provided in order to alternately directing most part of the flow of exhaust gases from the inlet port 2 towards either one of the first collecting member 81 or the second collecting member 82 while blocking the flow of exhaust gases through the other member.

In the partition wall 40, a heated air supplying means 10 is provided and a heated air outlet port 105 opens into the inlet chamber 6 so as to be opposed to the inlet port 2 with the diverter valve 9 between.

Heated air is supplied from the heated air supplying means 10 through the heated air outlet port 105 and collides against the diverter valve 9. Then, the heated air is directed into the exhaust gas flowing passage wherein the inactive collecting member is disposed to burn the particulates previously collected by the inactive collecting member.

Next, when the position of the diverter valve 9 is changed, heated air supplied from the heated air collides against the diverter valve 9 and flows into the other collecting member.

The particulates cleaning device of the first embodiment is interposed between the exhaust pipes (not shown). The device is connected to the exhaust pipes by means of flanges 21 and 31 which are provided in the inlet port 2 and the outlet port 3 respectively.

As shown in FIG. 3, the housing 4 is made of heat resistant metallic plate such as stainless steel and is prepared by welding opposed flange portions formed on the outer peripheries of an upper housing and a lower housing so that within the housing 4, a first and a second exhaust gas flowing passages 51 and 52 which are divided by the partition wall 40, are formed.

Each of the particulates collecting members 81 and 82 is made of heat resistant body having a large number of narrow open passages fro catching and collecting particulates contained within exhaust gases, such as foamed ceramic body.

In the space 13 formed between the outer peripheral surface of each of the collecting members 81 and 82 and the inner peripheral surface of the housing 4, a shock absorbing member 14 is disposed to radially support each of the collecting member 81 and 82. The shock absorbing member 14 prevents the collecting members 81 and 82 from being damaged due to shock applied thereto.

Both ends of each of the collecting members 81 and 82 are surrounded by annular cushion members 15 of metallic fine wire fabric, which are inserted within the space 13 under pressure.

The annular cushion members 15 prevent the collecting members 81 and 82 from being damaged due to vibrations and shock applied thereto in the axial direction.

And in the space 13, an annular sealing member 16 is inserted under pressure in order to prevent the exhaust gases from being discharged through the space without being cleaned.

The sealing member 16 is formed by compressing metallic fine wire such as Inconel or stainless steel fine wire fabric of which diameter is about 0.1 to 0.15 mm, into bulk density of about 4 g/cm$^3$.

Figure 8:
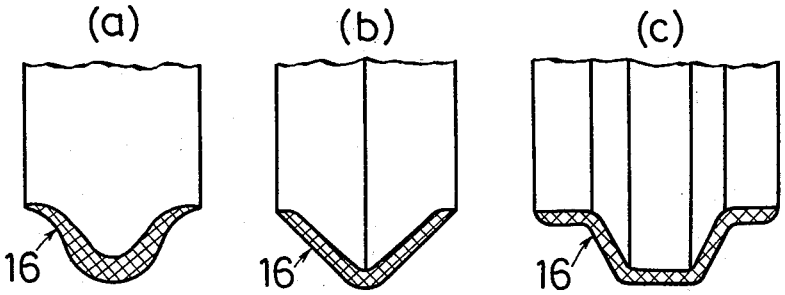
FIG. 8 is a sectional view taken along the line VIII—VIII of FIG. 7.

The sealing member 16 has a wavy, V-shaped or trapezoid cross section as shown in FIG. 8(*a*), (*b*) and (*c*).

By forming the sealing member 16 ito such a shape as described above, large resiliency can be obtained so that the sealing member 16 is closely contacted with the collecting members 81 and 82 with excellent sealing effect.

As the diverter valve 9, a butterfly valve is used. By using the butterfly valve, the exhaust gases smoothly flow into the active collecting member and the heated air supplied from the heated air supplying passage smoothly flows into the inactive collecting member.

The valve plate 90 of the butterfly valve 9 is formed into an elliptical shape which is obtained by cutting a column in the surface which is inclined to the central axis thereof by a predetermined angle. The valve plate 90 is axially supported along the short axis thereof by a valve shaft 93.

The valve shaft 93 is turned by means of a manual or automatic control device (not shown) through a lever 94 which is fixed to the valve shaft 93 by a nut 95 as shown in FIG. 4.

In the periphery of the valve plate 90, inclined surfaces 91 and 92 extending from both surfaces of the valve plate 90 are formed.

The angle of inclination of each of the inclined surfaces 91 and 92 to each of the surfaces of the valve plate 90 is continuously changed. The angle of inclination is the minimum (about 90°) in the peripheral portions which are opposed to the short axis of the valve plate 90 and is the maximum in the peripheral portions which are opposed to the long axis thereof.

In the inner wall of the housing 4 for defining the exhaust gas inlet chamber 6, two valve seats 96 and 97 for receiving the periphery of the valve plate 90 when each of the exhaust gas flowing passages 51 and 52 is closed thereby, are formed. Each valve seat 96 or 97 has a curvature nearly equal to that of the valve plate 90 and is provided with an inclined surface corresponding to the inclined surface 91 and 92 formed in the valve plate 90.

By forming the valve plate 90 and the valve seats 96 and 97 as described above, the butterfly valve 9 automatically fits into each of the valve seats 96 and 97 when the butterfly valve 9 turns to close each of the exhaust gas flowing passages 51 and 52 and is received thereby.

Therefore, the clearance between the valve shaft 93 and the bearing (not shown) can be made larger than that formed in the conventional bearing portion of this type. As a result, galling can be prevented from occurring between the valve shaft 93 and the bearing.

Figure 5:
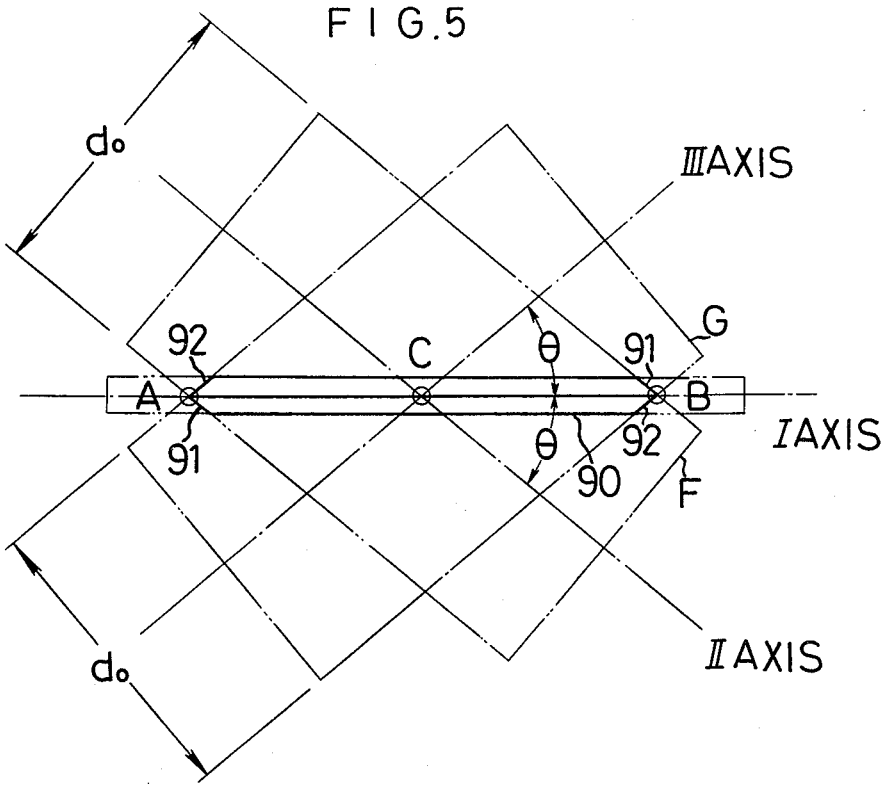
FIG. 5 is a detail view of a butterfly valve used as the diverter valve in the device of the present invention.

FIG. 5 shows one example of the design of the butterfly valve.

The valve plate 90 extends in the direction perpendicular to the sheet surface of FIG. 5. C designates one point on the axis I which extends through the center of the valve plate in the direction of thickness in parallel with the surface thereof. F and G designate imaginary columns having a diameter of do respectively, of which central axes II and III intersect at the point C. Each of the axes II and III is inclined to the axis I by an angle $\theta$.

The periphery of the valve plate 90 is formed into such a shape as to be cut by the imaginary columns F and G. As a result, in the periphery of the valve plate 90, inclined surfaces 91 and 92 extending from the surfaces of the valve plate 90, are formed.

The angle of inclination of each of the inclined surfaces 91 and 92 to each of the surfaces of the valve plate 90 is continuously changed. The angle of inclination in the maximum in the peripheral portions which are opposed to the long axis (A-B) and is the minimum (about 90°) in the peripheral portions which are opposed to the short surface of FIG. 5 through the point C.

As shown in FIG. 2, the butterfly valve 9 turns by the angle $2\theta$ for changing the position thereof to close another exhaust gas flowing passage.

Each of the valve seats 96 and 97 has an inclined surfaces of which shape is nearly equal to that of each of the inclined surfaces 91 and 92 of the butterfly valve 9 extending along the side surface of the imaginary columns F or G on the plane inclined to the central axis thereof by the angle $\theta$.

And it is preferable that the inner diameter of each of the valve seats 96 and 97 is made slightly larger than the corresponding outer diameter of the butterfly valve 9 in order to smoothly operate the butterfly valve 9.

By using the butterfly valve having the above described construction as the diverter valve 9, the exhaust gases are allowed to flow into either one of the collecting members 81 and 82 and are blocked to flow into the other collecting member.

As the heated air supplying means 10, a burner, electric heater or the like can be used.

Hereinafter, the operation of the exhaust gas cleaning device of the first embodiment will be explained.

The exhaust gases containing particulates discharged from the internal combustion engine flow into the housing 4 through the inlet port 2.

When the butterfly valve 9 is positioned so as to block the exhaust gas flowing passage 52 communicated with the second collecting member 82 as shown in FIG. 3, the exhaust gases flow towards the first collecting member 81 as shown by hatched arrows and clean exhaust gases are discharged from the outlet port 3 as shown by a white arrow after the particulates are eliminated by the first collecting member 81. And in the second collecting member 82, particulates have been previously collected.

At this time, by operating the heated air supplying means 10, heated air of a temperature as high as 900° C. to 1200° C. is blown into the inlet chamber 6 and collides agianst the butterfly valve 9. Then, the heated air directs towards the second collecting member 82.

The butterfly valve 9 is heated by the heated air but the exhaust gases of a temperature as relatively low as 100° C. to 300° C. flow along the reverse surface of the butterfly valve 9 to cool the butterfly valve 9.

Therefore, the butterfly valve 9 can be maintained at a temperature as relatively low as 300° to 400° C. Consequently, galling is prevented from occurring in the valve shaft 93 of the butterfly valve 9 and the durability of the valve plate and the valve shaft 93 can be remarkably increased.

After colliding against the butterfly valve 9, the heated air flows into the second collecting member 82 as shown by a broken arrow and heats and burns the collected particulates.

Then, the heated air flows into the outlet chamber 7 and is joined with the flow of cleaned exhaust gases therein. And the mixture is discharged through the outlet port 3.

When the volume of the particulates collected by the first collecting member 81 reaches such a predetermined level as to restrict the flow of exhaust gases, the butterfly valve 9 is turned into the position shown by an imaginary line shown in FIG. 2 by means of the manual or automatic control device (not shown).

Then, the exhaust gases flow into the second collecting member 82 which has been cleaned by burning the collected particulates, and the exhaust gases are cleaned thereby. And into the first collecting member 81, heated air is supplied to heat and burn the particulates which have been previously collected therein. The above described operation is continuously repeated.

Figure 1:
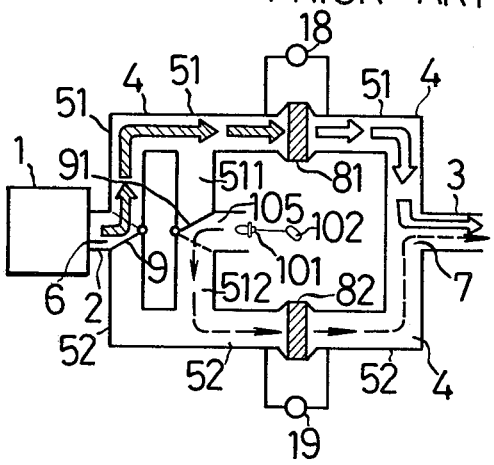
FIG.1 PRIOR ART
FIG. 1 is a longitudinal sectional view of one example of a conventional exhaust gas cleaning device.

According to the first embodiment of the present invention, such a heated air diverter means 91, heated air supplying passages 511 and 512 and a control device (not shown) for operating the diverter valve means 9 and the heated air diverter means 91 coincidently as shown in one example of the conventional exhaust gas cleaning device of FIG. 1, are unnecessary.

And since the butterfly valve 9 is cooled by the exhaust gases, galling does not occur in the valve shaft 93 and the durability of the valve plate and the valve shaft is improved. As a result, an exhaust gas cleaning device having excellent durability can be obtained.

Furthermore, by using the annular sealing member 16, the exhaust gas can be prevented from leaking from the space 13 between the housing 4 and the collecting member 81 or 82.

Figure 6:
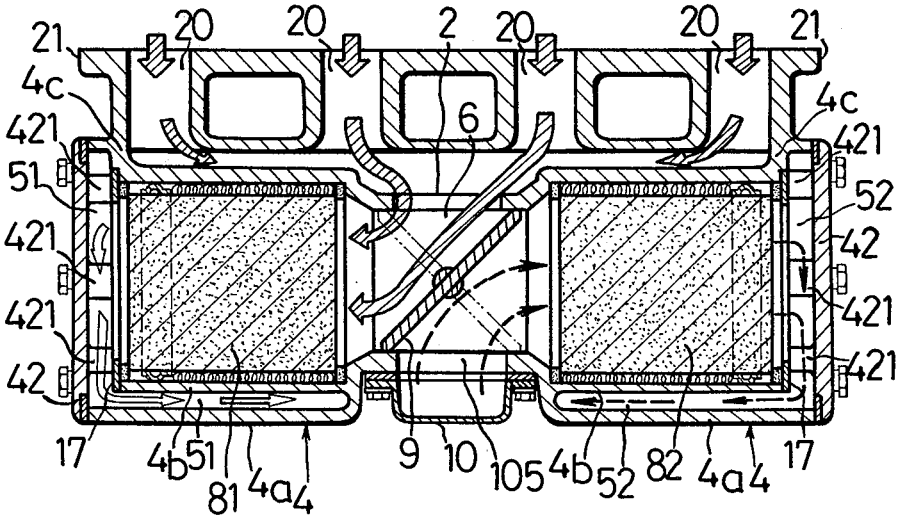
FIG. 6 is a longitudinal sectional view of a second embodiment of the present invention.

FIG. 6 shows the exhaust gas cleaning device of a second embodiment of the present invention, which also serves as an exhaust manifold.

Figure 7:
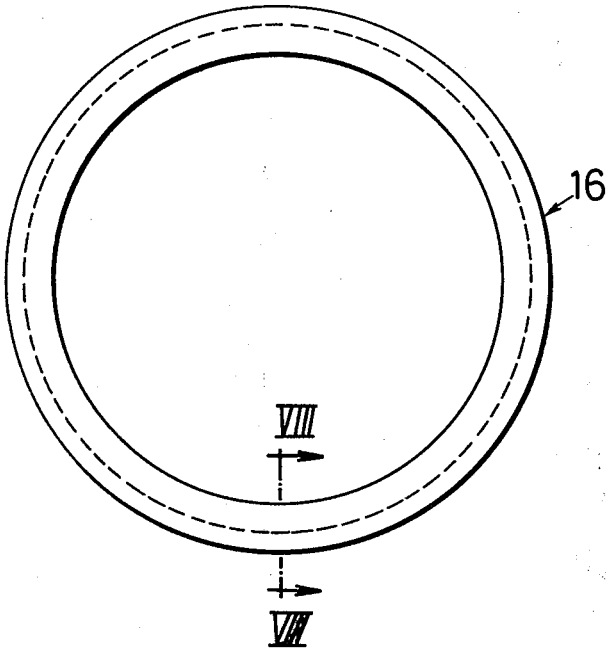
FIG. 7 is a plan view of a sealing member used in the device of the present invention.

In the exhaust gas cleaning device of the second embodiment shown in FIG. 7, the housing 4 is provided with four exhaust gas supplying passages 20 which are communicated with the exhaust gas inlet port 2 of the exhaust gas inlet chamber 6.

And the four exhaust gas supplying passages 20 are communicated with exhaust ports (not shown) of an internal combustion engine through a flange 21. The outlet port 3 is connected to an exhaust pipe (not shown) through a flange (not shown). The housing 4 is composed of an outer housing **4*a* and an inner housing 4*b*. And a partition wall 4*c* is provided between the outer housing 4*a* and the inner housing 4*b*** for separating the inlet gas flowing passage and the outlet gas flowing passage.

Within the inner housing **4*b*, columnar particulates collecting members 81 and 82** are coaxially disposed so as to be opposed to each other.

To both opening ends of the housing 4, crown-shaped caps 42 provided with a plurality of projecting portions 421 which presses the collecting members 81 and 82 in the axial direction thereof through annular metallic plates 17 are fixed respectively.

Between the outer periphery of each of the collecting members 81 and 82 and the inner periphery of the inner housing **4*b*, a shock absorbing member 14 and an annular sealing members is axially supported by cushion members 15**.

Between the opposed end surfaces of the collecting members 81 and 82, an exhaust gas inlet chamber 6 leading to the inlet ports 2 is formed. Within the exhaust gas inlet chamber 6, the butterfly valve 9 is disposed and the heated air blowing port 105 of the heated air supplying means 10 opens into the exhaust gas inlet chamber 6 so as to be opposed to the butterfly valve 9.

The exhaust gas outlet chamber (not shown) is formed in the nearly central portion of the outer housing **4*a*** in the axial direction thereof and is communicated with the outlet port (not shown).

Other construction of the second embodiment is substantially equal to that of the first embodiment.

When the butterfly valve 9 of the exhaust gas cleaning device having the above described construction, is positioned so as to permit the exhaust gases to flow only into the collecting member 81 as shown in FIG. 6, the exhaust gases containing particulates flow from the exhaust gas flowing passage 2 into the collecting member 81 through the inlet port 2 and inlet chamber 6 as shown by hatched arrows and after the particulates are eliminated by the collecting member 81, the cleaned exhaust gases flow between the outer housing **4*a* and the inner housing 4*b* as shown by white arrows and are discharged from the outlet port 3 through the outlet chamber 7**.

The heated air from the heated air supplying means 10 is supplied into the collecting member 82.

As a result, the collected particulates are burnt off and combustion gases flow as shown by broken arrows and mix with the cleaned exhaust gases in the outlet chamber 7. And the mixture is discharged from the outlet port 3.

According to the second embodiment of the present invention, the same effect as the first embodiment can be obtained.

As described above, the exhaust gas cleaning device of the present invention comprises a housing wherein two independent exhaust gas flowing passages are formed, particulates collecting members which are disposed in the exhaust gas flowing passages respectively, a heated air supplying means for supplying heated air into the exhaust gas inlet chamber, and a butterfly valve provided in the exhaust gas inlet chamber for directing the exhaust gases from the exhaust gas inlet chamber to one of two exhaust gas flowing passages and directing the heated air from the exhaust gas inlet chamber to the other exhaust gas flowing passage.

According to the present invention, such heated air supplying passages 511 and 512 and heated air diverter valve 91 as comprised by the conventional device shown in FIG. 1 are unnecessary. And also, the control device for operating two valves 9 and 91 of the conventional device shown in FIG. 1 at the same timing, is unnecessary.

Therefore, the exhaust gas cleaning device of the present invention can be made simple, light and small. As a result, the device can be easily mounted in a limited space of the vehicle with improved effect.

Furthermore, the temperature of the butterfly valve against which heated air collides, can be lowered so that durability of the device is largely improved compared ith the conventional device.

Having now fully described the invention, it will be apparent to one of ordinary skill in the art that many changes and modifications can be made thereto without departing from the spirit or scope of the invention as set forth herein.

What is claimed is:

1. An exhaust gas cleaning device for collecting and burning particulates contained within exhaust gases discharged from an internal combustion engine, comprising:

a housing provided with an exhaust gas inlet chamber which is communicated with an exhaust gas inlet port, an exhaust gas outlet chamber which is communicated with an exhaust gas outlet port, and two independent exhaust gas flowing passages which are formed between said exhaust gas inlet chamber and said exhaust gas outlet chamber so as to be communicated therewith;

a pair of particulates collecting members for collecting said particulates, which are made of heat resistant material having air permeability;

each of said collecting members being disposed within each of said exhaust gas flowing passages;

an exhaust gas diverter valve which is disposed within said inlet chamber so as to be opposed to said exhaust gas inlet port for alternately directing the exhaust gas flowing from said exhaust gas inlet port to either one of said exhaust gas flowing passage while blocking the exhaust gases to the other flowing passage;

a heated air supplying means for burning off said particulates collected in said collecting member disposed in said other flowing passage;

said exhaust gas diverter valve being composed of a butterfly valve which is supported by a valve shaft in the central portion of said inlet chamber so as to turn by a predetermined degree clockwise and counterclockwise; and said heated air supplying means comprising a heated air outlet port which opens into said exhaust gas inlet chamber so as to be opposed to said exhaust gas inlet port with said butterfly valve between.

2. An exhaust gas cleaning device according to claim 1, wherein:

each of said collecting members is made of foamed ceramic or ceramic honeycomb structure.

3. An exhaust gas cleaning device according to claim 1, wherein:

said exhaust gas flowing passages are formed in parallel with each other between said exhaust gas inlet chamber and said exhaust gas outlet chamber; and said exhaust gas flowing passages are separated from each other by a partition wall formed therebetween.

4. An exhaust gas cleaning device according to claim 3, wherein:

said heated air supplying means further comprises a heated air supplying passage which supplies heated air into said exhaust gas inlet chamber from said heated air outlet port; and said heated air supplying passage and said heated air outlet port are formed in said partition wall.

5. An exhaust gas cleaning device according to claim 1, wherein:

said exhaust gas flowing passages are coaxially formed;

and said exhaust gas inlet chamber is formed between the opposed ends of said exhaust gas flowing passages.

6. An exhaust gas cleaning device according to claim 5, wherein:

said exhaust gas inlet port opens in the axially central portion of said exhaust gas inlet chamber; and said heated air outlet port opens into said exhaust gas inlet chamber on the opposite side to said exhaust gas inlet port.

7. An exhaust gas cleaning device according to claim 6, wherein:

said housing is composed of a cylindrical outer housing and a cylindrical inner housing which is disposed within said outer housing so as to be communicated with each other in both ends thereof;

said exhaust gas inlet chamber is formed in the axially central portion of said inner housing; and said particulates collecting members are disposed within said inner housing.

8. An exhaust gas cleaning device according to claim 7, wherein:

said housing further comprises a plurality of exhaust gas supplying passages which are communicated with said exhaust gas inlet chamber through said inlet port for supplying exhaust gases from a plurality of exhaust ports of said internal combustion engine into said exhaust gas inlet chamber through said inlet port.

9. An exhaust gas cleaning device according to claim 1, wherein:

said butterfly valve is composed of an elliptical valve plate of which short axis is rotatably supported within said exhaust gas inlet chamber and two valve seats which receive said valve plate when said valve plate turns by a predetermined angle;

in the peripheral portion of said valve plate, inclined surfaces extending from both surfaces of said valve plate are formed;

the angle of inclination of each of said inclined surfaces to each of said surfaces of said valve plate is continuously changed;

said angle of inclination is the maximum in the peripheral portion of said valve plate opposed to a long axis thereof and is the minimum in the peripheral portion of said valve plate opposed to said short axis; and each of said valve seats has a shape corresponding to the shape of the periphery of said valve plate.

10. An exhaust gas cleaning device according to claim 9, wherein:

said valve plate has a shape which is obtained by cutting a plate in the surfaces contacted with two imaginary columns having the same diameter, of which axes extend on the same plane perpendicular to said plate, intersect at a certain point positioned at a center of said plate in the direction of thickness, and are inclined to the surface of said plate at the same angle as each other and;

each of said inclined surfaces has a shape formed along the outer peripheral surface of each of said two imaginary columns.

11. An exhaust gas cleaning device according to claim 1, wherein:

a heat resistant shock absorbing member and at least one annular heat resistant sealing member are disposed in the space formed between the outer surface of each of said particulates collecting members and the wall of each of said exhaust gas flowing passages.

12. An exhaust gas cleaning device according to claim 11, wherein:

said shock absorbing member is made of metallic wire.

13. An exhaust gas cleaning device according to claim 11, wherein:

said sealing member is formed by compressing a metallic wire fabric so as to have a wavy, V-shaped or trapezoid cross section.

* * * * *